US010300367B1

(12) United States Patent
Douglas, Jr.

(10) Patent No.: US 10,300,367 B1
(45) Date of Patent: May 28, 2019

(54) MAGNETIC GAME SET FOR RANDOMIZABLE PLAY

(71) Applicant: Johnny H Douglas, Jr., Syracuse, NY (US)

(72) Inventor: Johnny H Douglas, Jr., Syracuse, NY (US)

( * ) Notice: Subject to any disclaimer, the term of this patent is extended or adjusted under 35 U.S.C. 154(b) by 0 days.

(21) Appl. No.: 15/885,890

(22) Filed: Feb. 1, 2018

(51) Int. Cl.
*A63F 3/00* (2006.01)

(52) U.S. Cl.
CPC ..... *A63F 3/00694* (2013.01); *A63F 3/00261* (2013.01); *A63F 2003/00359* (2013.01)

(58) Field of Classification Search
CPC ..... A63F 3/00694; A63F 3/00261; A63F 2003/00359
See application file for complete search history.

(56) References Cited

U.S. PATENT DOCUMENTS

| | | | | |
|---|---|---|---|---|
| 2,526,123 | A | 10/1950 | Dawson | |
| 2,819,904 | A | 1/1958 | Nelson | |
| 3,556,526 | A | 1/1971 | Curtis | |
| 3,625,514 | A | 12/1971 | Haaland | |
| 3,674,272 | A | 7/1972 | Wszalek | |
| 3,860,242 | A * | 1/1975 | Martin | A63F 3/00 273/243 |
| 4,013,293 | A | 3/1977 | Hess et al. | |
| 4,021,042 | A | 5/1977 | Sweeton | |
| 4,164,351 | A | 8/1979 | Baker | |
| 4,546,981 | A * | 10/1985 | Elizondo | A63F 3/00261 273/260 |
| 5,265,885 | A | 11/1993 | Blount | |
| 5,328,188 | A | 7/1994 | Brotz | |
| 2008/0258386 | A1 | 10/2008 | Eastman | |
| 2009/0243214 | A1* | 10/2009 | Kean | A63F 3/00694 273/239 |
| 2014/0217673 | A1* | 8/2014 | Severance | A63F 9/0098 273/299 |

* cited by examiner

*Primary Examiner* — Eugene L Kim
*Assistant Examiner* — Jeffrey S Vanderveen
(74) *Attorney, Agent, or Firm* — Bernhard P. Molldrem, Jr.

(57) ABSTRACT

A game set for a randomizable table game includes a game board and a plurality of game pieces. The game board holds a number of magnetic tiles, each said tile containing a predetermined number of coin magnets with the coin magnets serving as play spaces on the game board. The game pieces each include a transparent hollow body that has opposite generally flat faces and can be set onto a selected magnet or space on the game board. A coin magnet in the transparent hollow body can invert or be held in its original position depending on whether the polarities of the playing piece and tile magnets match. Players may attempt to achieve a row of three game pieces with indicia on the magnets being all X or all O.

10 Claims, 2 Drawing Sheets

MAGNETIC GAME SET FOR RANDOMIZABLE PLAY

The present invention is concerned with parlor games of the type where a game piece or "man" can be placed on a game board having play spaces, i.e., squares, or other markings, and the game pieces can be moved from one play space to another on the board.

The present invention is further concerned with a game set wherein the board contains an array of magnets placed at the play spaces or squares on the board, and in which the game pieces each take the form of a hollow transparent body, e.g., a cylinder, and each containing a coin magnet, i.e., disk magnet, that enjoys freedom of movement within the interior of the hollow body, such that when the game piece is placed on the board at a position of one of the magnets, the coin magnet within the game piece will stay in position if the board's magnet at that location is one given polarity, but will flip to an inverted position if the board's magnet is the other magnetic polarity. The coin magnet in the game piece will automatically flip or not, as need be, so that there are respective N and S poles facing each other.

The present invention is also concerned with such a game set in which the polarities of the magnets at the spaces on the game board can be re-arranged in simple fashion and thus more-or-less "randomized" so that play of the game becomes less predictable.

OBJECTS AND SUMMARY OF THE INVENTION

It is an object of the invention to provide a game set that can facilitate the play of simple games, difficult and complex games, or games of medium complexity, and can randomize the result of placing a game piece at any given play space on the board.

It is another object to provide a game set that permits the players to play an unlimited styles of games not limited only to a single set of rules.

A further object is to provide a game set where the board may be made of any of a variety of sizes and number of playing spaces or board magnets, for example, 6×6, 9×9, 12×12 and so forth.

A related object is to provide the game board with the flexibility ofre-arranging the magnetic spaces on the board so that the game remains unpredictable from one game to the next.

According to an aspect of this invention, the game set has a game board and a suitable number of game pieces that can be placed on the board at a player's discretion, that is, upon open spaces defined on the game board. The game board includes a plurality of magnetic tiles, e.g., strips of wood, plastic, or other suitable material, with each said tile containing some predetermined number of coin magnets. These are kept held in place in predetermined positions on the respective tile. The coin magnets serve also as the play spaces on the game board. A fence or other suitable structure serves as a boundary on the game board which defines a fenced-in area or suitable length and width so it can be filled with a predetermined number of these tiles, such that the coin magnets in the tiles form a two-dimensional array in the fenced-in area. This permits the game pieces to be placed in different patterns, i.e., vertical, horizontal, or diagonal, on the game board.

The game pieces each include a transparent hollow body, e.g., clear plastic cylinder, that has opposite generally flat faces thereon and which is adapted to be placed with either of said generally flat faces of the hollow body facing down, i.e., against an available one of the play spaces on the game board. A coin magnet is contained within the transparent closed body, which has sufficient interior space to permit magnet to be inverted, i.e., flipped. The coin magnet has two opposite faces, one N and one S, there are distinctive indicia on each face and so that the faces are visually distinctive one from the other. For example, one face can bear an "X" marking and the other an "O" marking. Preferably, the two faces can be both the same color, i.e., both red or both yellow, or they can be two different colors.

In a preferred embodiment, the game board includes a flat base board member and the boundary can take the form of a rectangular raised fence defining the boundaries of the fenced-in area. In other embodiments the boundary can be a triangle or another geometric shape. Also, a ferromagnetic sheet can cover the fenced in area, holding and keeping the coin magnets of the tiles in place in the fenced-in area. In the described embodiment, the tiles are each formed as a rectangle dimensioned to hold a single row of a predetermined number of said coin magnets, where the coin magnets of strips are each magnetized such that one face of the respective coin magnet is a north magnetic pole and the opposite face thereof is a south magnetic pole. The strips in this example each contain a row of three coin magnets, and the strips each have a predetermined width and a length substantially three times that width. The fenced-in area of the game board in this example is configured to hold two columns of six tiles. This creates an array of six by six coin magnets.

Favorably, each game piece includes a cylinder of a transparent material with an inside diameter larger than the diameter of the respective coin magnet inside it. The coin magnets of at least some of the game pieces have indicia of one given color, and the magnets of at least some of the remaining ones of said game pieces have indicia of another given color. There are enough game pieces in enough different colors to allow play by multiple players who may play as independent players or as partners.

Of course, there is no arbitrary limit to the number of tiles or size of the tiles that can be used on any given game set or of the number of play pieces.

The preferred embodiment of the present invention, given here as an example of a game set on which a number of different games may be played by two or more players, will now be described in connection with the accompanying Drawing.

DETAILED DESCRIPTION OF THE PREFERRED EMBODIMENT

Figure 1:
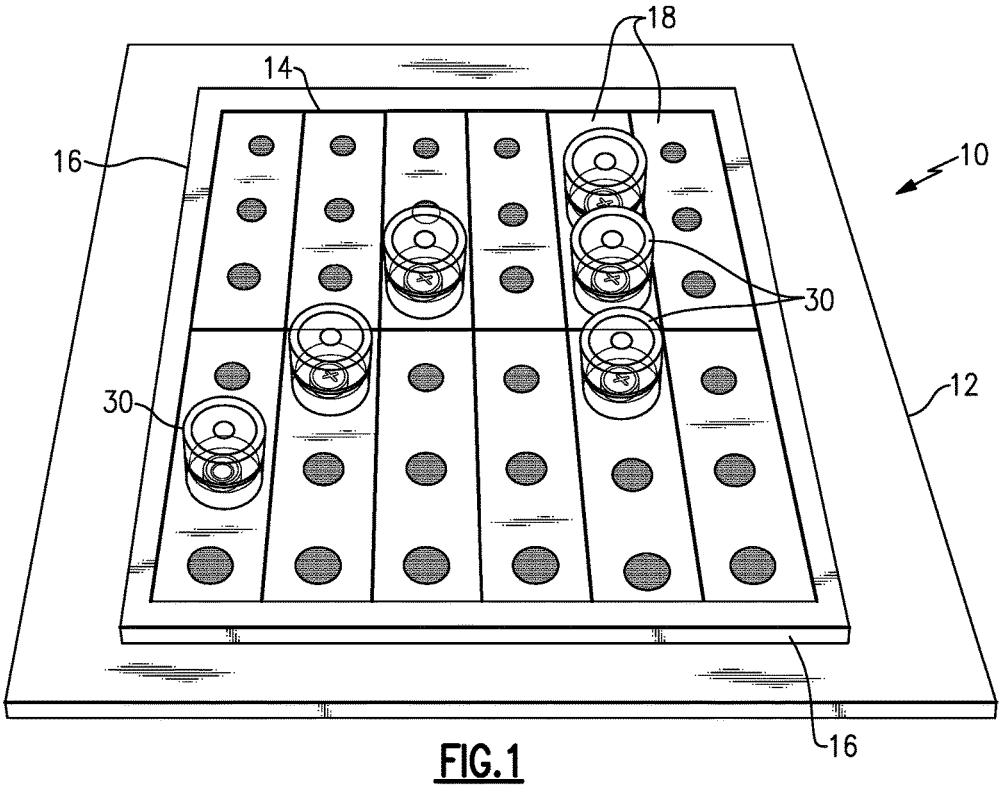
FIG. 1 is a perspective view of the game set including the game board, magnet strips, and game pieces, for this embodiment.
Figure 2:
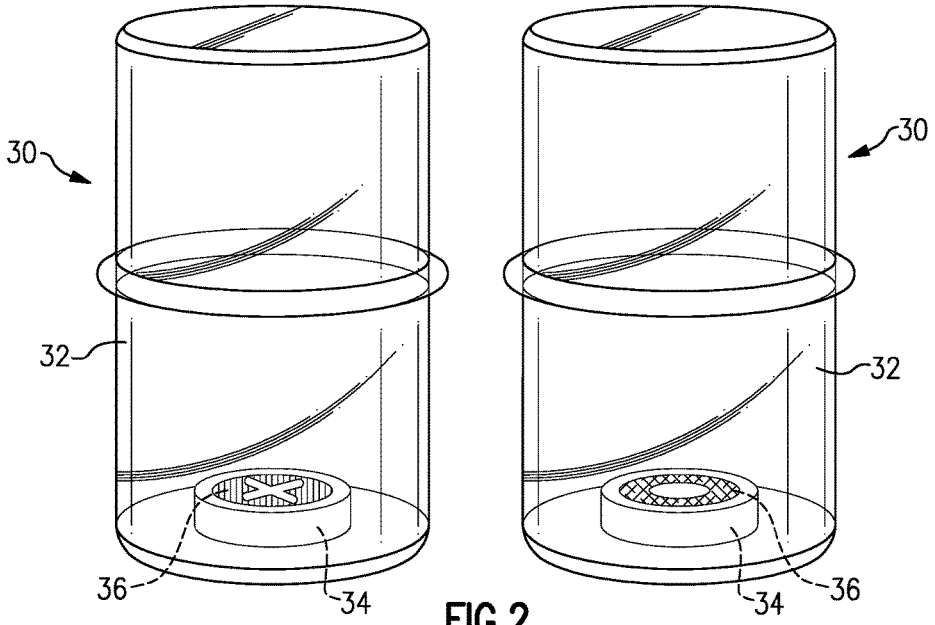
FIG. 2 is an enlarged perspective view of two of the game pieces of this embodiment.
Figure 3:
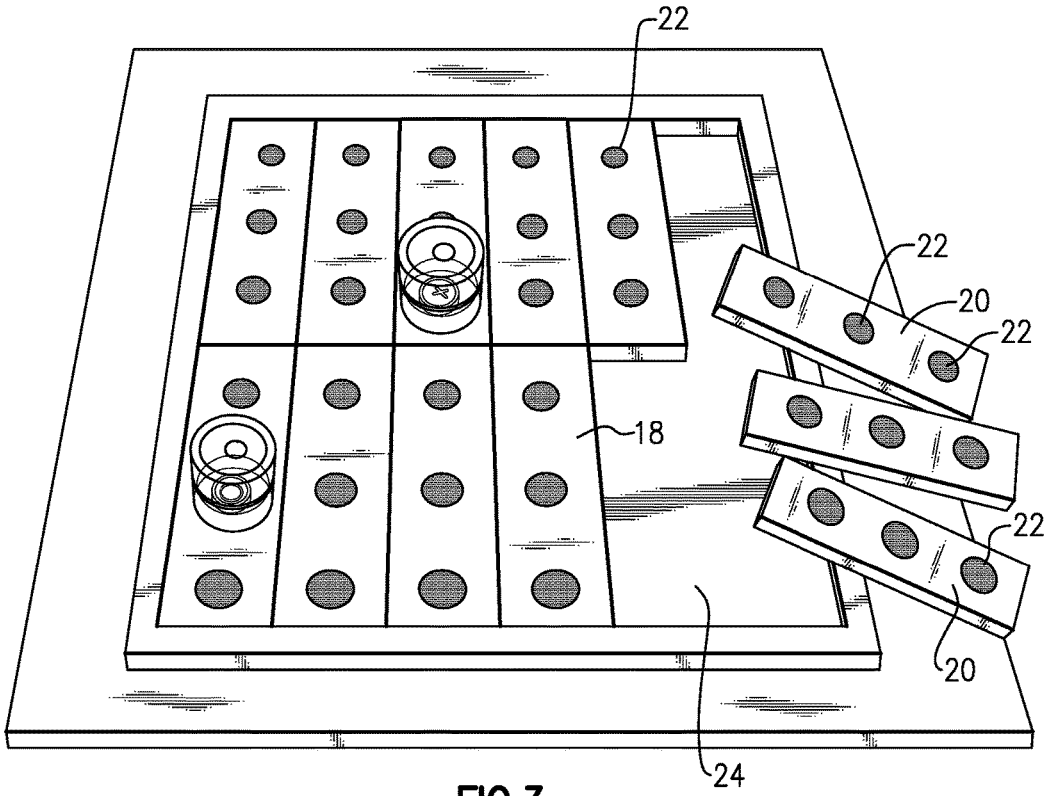
FIG. 3 is another perspective view, showing some of the magnet strips lifted out of the fenced-in area to reveal a ferromagnetic sheet beneath the tiles.
Figure 4:
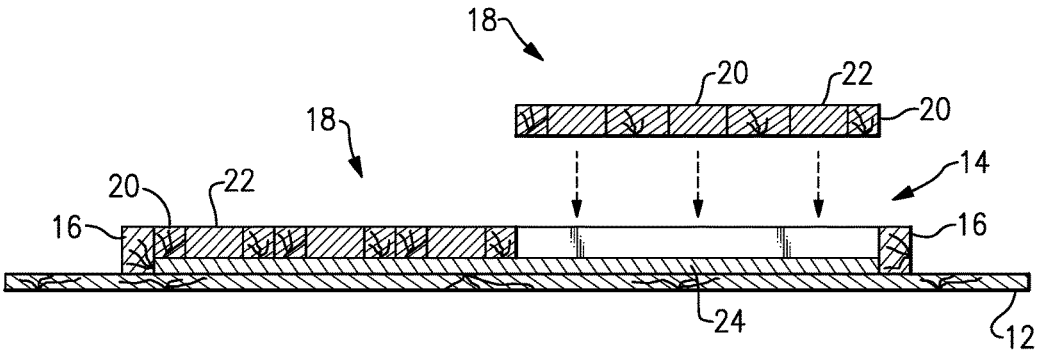
FIG. 4 is a cross sectional view of the game board and magnet tiles.

With reference to the Drawing, and initially to FIG. 1 thereof, the game set comprises a game board 10 and a number of game pieces 30. In the play of one selected game, there are three game pieces for each player, with each group of three being marked a distinctive color for that player.

The game board, made of e.g., wood, paperboard, plastic or composite, has a base 12 of a hard flat material, with a central play area 14, which is a square in this embodiment. A boundary wall or fence 16 surrounds the play area and defines its limits. Here, the wall or fence 16 extends above the board 12, but as this serves as a boundary marker, the fence need not have an actual thickness, but could be a solid line or band painted or printed on. A set of magnetic tiles 18, here two columns of six tiles 18, are fitted into the play area 14. Here, each tile 18 has a board 20 (of non-magnetic material) dimensioned three units long by one unit wide, with a set of coin magnets 22 fitted into receptacles in the board 20. In this case there are three half-inch diameter coin magnets in each tile, each with a North polarized side and a South polarized side. Favorably the orientation of the poles is randomized so as to make the play of the magnetic games unpredictable. There is a sheet 24 of iron or another ferromagnetic material situated at the floor of the play area which attracts the magnets 22 and holds the tiles 18 in place within the boundary wall or fence 16, although these can be lifted out by the players and re-arranged as desired.

The playing pieces 30 in this embodiment take the form of clear plastic hollow cylinders 32 with a round side wall and with flat upper and lower faces, either of which can be positioned on top of any given magnet 22 of the tiles 18 in the play area. In some embodiments, only one face of the transparent playing piece is flat. Within each cylinder 32 is a coin magnet 34 that is of smaller diameter than the inside of the cylinder so that it is free to flip or invert, as discussed shortly. Each magnet 34 has a label or marking 36, i.e. indicia, on each of its faces, one marked with an "X" and one with an "O". (In other embodiments other markings can be used). These indicia are colored with respective colors for the different players, i.e., there may be a set of twelve play pieces, with three each of yellow, orange, blue, and green. As with the magnets in the tiles 18, these magnets have one North or N face and an opposite South or S face.

As may be noted, the square array of magnetic tiles 18 creates an array of six by six magnets 22 on the play area. These tiles can be lifted and place with the other side down, or flipped end-for-end, or they may be placed in different positions, all of which serves to randomize the positions on the play area where the N magnet poles are and where the S magnet poles are.

While many possible games may be played with this game set, a game of "tic tac toe random" will be described here to illustrate how the game board and game pieces work together.

In this game the playing board i.e., the array of 6×6 magnets has the magnets 22 arranged in a mix of N and S pole faces, which is not known to the players and can be randomized between games. There are four sets of three each of the game pieces 30, each set with the disk magnets or coin magnets marked with indicia that are X on one side and O on the other, and marked with a given color for that set. This allows as many as four players to engage in a game at any given time. As aforesaid, the magnetic tiles 18 can be moved, flipped over or turned end-for-end and otherwise rearranged to randomize the arrangement of the magnetic poles.

To play, the players decide the order of play, and then each player in turn will place (not slide) one of their playing pieces onto the board, with the objective of creating a row of three game pieces that are all "X" or all "O". The coin magnets 34 that are enclosed in their respective cylinders 32 will either attract to the magnet 22 that it is placed on, or else the magnet 22 will repel the game piece magnet 34 and cause it to flip onto its opposite side, displaying an "O" if it had previously shown "X" and vise versa. The first player to achieve a row in the player's color of three X's or three O's, vertically, horizontally, of diagonally, will be the winner, but only after other players have had one more turn to attempt to create a row in their color. Where the player's pieces are a mix of "X" and "O" pieces on the play area, the player can move one of the play pieces to another spot on the play area in his or her next turn.

Of course this game set can be used for other games besides the simple one here described, where a randomness of which side of the magnet is presented can add to the complexity of the game. Other games may have a larger play area, e.g., 9×9 or 12×12 array of magnets. In some game boards, the magnetic tiles may fit into a triangular, hexagonal, or octagonal play area rather than a square one. Many other possible variations in the game set can be used for any of a variety of games where the game piece 30 may change from one indicia to another depending on where it is placed on the board.

Variations and modifications will become apparent to persons skilled in board game design without departing from the scope and spirit of the invention, as defined in the appended claims.

What is claimed is:

1. A game set comprising a game board and a plurality of game pieces to be placed at a player's discretion upon spaces defined on the game board, wherein said game board includes a plurality of re-arrangeable magnetic tiles, each said tile containing a predetermined number of coin magnets held in place in predetermined positions on the respective tile, said coin magnets each having one N pole face and an opposite S pole face; said coin magnets serving also to define said spaces for the game pieces on the game board, and a boundary on the game board defining a fenced-in area dimensioned to be filed with a predetermined number of said tiles, such that the coin magnets in said tiles form a two-dimensional array in the fenced-in area;

said game pieces each include a transparent hollow body that has one or more flat faces thereon and such that the transparent hollow body is adapted to be placed with either or any of said flat faces against an available one of said spaces on said game board, and a coin magnet contained therewithin, the respective coin magnets within the transparent hollow bodies of the game pieces each having one N pole face and an opposite S pole face; said transparent open body having sufficient interior space to provide freedom of movement for the coin magnet within the respective hollow body and to permit said magnet to be inverted by magnetic action, said coin magnet having opposite faces and being configured such that when one of said game pieces is placed on the board at a position of one of the coin magnets in a respective tile, the coin magnet within the game piece will stay in position if the board's magnet at that location is one given polarity, but will flip to an inverted position if the board's magnet is the other magnetic polarity, and wherein the coin magnet in the game piece will automatically flip or not, as need be, so that there are respective N and S poles facing each other, and wherein each said coin magnet in its respective transparent hollow body has distinctive indicia on each said face and visually distinctive one from the other.

2. The game set according to claim 1, wherein said game board includes a flat board member with said boundary being in the form of a rectangular raised fence defining the boundaries of said fenced-in area.

3. The game set according to claim 2, wherein said game board further includes a ferromagnetic sheet covering the fenced in area and attracting the coin magnets of said tiles when said tiles are placed within the fenced-in area.

4. The game set according to claim 1 wherein said tiles are each formed as a rectangle dimensioned to hold a single row of a predetermined number of said coin magnets.

5. The game set according to claim 1 wherein the coin magnets of said tiles are each magnetized such that one face of the respective coin magnet is a north magnetic pole and the opposite face thereof is a south magnetic pole.

6. The game set according to claim 1 wherein each said game piece includes a cylinder of a transparent material with an inside diameter larger than the diameter of the respective coin magnet therewithin.

7. The game set according to claim 6 wherein the coin magnet contain respective indicia on each of the faces thereof, being the same respective color for any given one of said game pieces.

8. The game set according to claim 6, where the coin magnets of at least some of the plurality of game pieces have indicia of one given color, and the magnets of at least some of the remaining ones of said game pieces have indicia of another given color.

9. The game set according to claim 1 wherein each of said tiles contains a row of three of said coin magnets, and said tiles each have a predetermined width and a length three times said width.

10. The game set according to claim 9 wherein said fenced-in area of said game board is configured to hold two columns of six of said tiles.

* * * * *